United States Patent [19]

Macaulay

[11] Patent Number: 4,977,131

[45] **Date of Patent: * Dec. 11, 1990**

[54] OCR SCANNABLE CARBONLESS COPYING SYSTEM AND A METHOD OF PRODUCING OCR SCANNABLE IMAGES THEREWITH

[75] Inventor: Norman Macaulay, Tonawanda, N.Y.

[73] Assignee: Moore Business Forms, Inc., Grand Island, N.Y.

[ * ] Notice: The portion of the term of this patent subsequent to Jul. 24, 2007 has been disclaimed.

[21] Appl. No.: 287,060

[22] Filed: Dec. 21, 1988

Related U.S. Application Data

[63] Continuation-in-part of Ser. No. 198,070, May 24, 1988.

[51] Int. Cl.[5] ..... B41M 5/22

[52] U.S. Cl. ..... 503/201; 427/150; 427/151; 503/204; 503/206; 503/220; 503/221; 503/226

[58] Field of Search ..... 427/150–152; 503/204, 206, 215, 226, 201, 220, 221

[56] References Cited

U.S. PATENT DOCUMENTS

| | | | |
|---|---|---|---|
| Re. 30,116 | 10/1979 | Maalouf . | |
| 2,417,897 | 3/1947 | Adams . | |
| 3,364,052 | 1/1968 | Martino . | |
| 3,491,111 | 1/1970 | Lin . | |
| 3,492,116 | 1/1970 | Lin . | |
| 3,565,005 | 2/1971 | Knott | 503/204 |
| 3,663,256 | 5/1972 | Miller et al. . | |
| 3,672,935 | 6/1972 | Miller et al. . | |
| 3,681,390 | 8/1972 | Lin . | |
| 4,020,056 | 4/1977 | Farber . | |
| 4,022,771 | 5/1977 | Farber . | |
| 4,026,883 | 5/1977 | Farber . | |
| 4,107,428 | 8/1978 | Farber . | |
| 4,119,776 | 10/1978 | Farber . | |
| 4,172,605 | 10/1979 | Welsch et al. . | |
| 4,403,793 | 9/1983 | McCormick et al. . | |
| 4,532,200 | 7/1985 | Arney et al. . | |
| 4,596,996 | 6/1986 | Sandberg et al. . | |
| 4,597,993 | 7/1986 | Okada et al. . | |
| 4,636,818 | 1/1987 | Jerabek . | |
| 4,662,651 | 5/1987 | Mowry, Jr. | 283/70 |
| 4,687,228 | 8/1987 | Van Malderghem et al. . | |

*Primary Examiner*—Bruce H. Hess

*Attorney, Agent, or Firm*—Finnegan, Henderson, Farabow, Garrett and Dunner

[57] ABSTRACT

A carbonless copying system which enables the formation of images that are capable of being detected by an optical character recognition (OCR) device. A phenolic resin or reactive clay image-forming component is applied as a CF coating on a recording substrate. A first complementary image-forming component which is a microencapsulated dye precursor that is capable of forming a colored image when contacting the CF coating is applied as a CB coating to a transfer substrate. A second complementary image-forming component, which is a microencapsulated dye precursor capable of forming a colored image when contacting the CF coating that is detectable by an OCR device, is applied as a CB coating to selected portions of the transfer substrate. The dye precursor capsules, upon rupture by application of pressure, release the dye precursor which contacts and reacts with the phenolic resin or reactive clay to form colored images, with those images formed from second complementary image-forming component being capable of detection by an OCR device. The carbonless copying system of the invention is particularly useful in credit card sales slip applications.

18 Claims, 1 Drawing Sheet

OCR SCANNABLE CARBONLESS COPYING SYSTEM AND A METHOD OF PRODUCING OCR SCANNABLE IMAGES THEREWITH

BACKGROUND OF THE INVENTION

This application is a continuation-in-part of application Ser. No. 198,070 filed on May 24, 1988.

The present invention relates to carbonless copying systems, and more specifically, a carbonless copying system which enables the formation on selected portions of a substrate, e.g., a sheet of paper, of images that are capable of being detected by an optical character recognition device.

As described in my co-pending application Ser. No. 198,070 and in U.S. Pat. No. 4,636,818, standard carbonless copying systems include a plurality of substrates, e.g., paper sheets, arranged in a manifold, each sheet having one or more coatings on a surface thereof. The manifold is designed so that when external pressure caused by a typewriter, pen, or other instrument is applied to the outermost sheet, a colored image will be formed on at least one surface of each sheet of the manifold.

The top sheet of the manifold to which the pressure is applied has a coating on its back surface. This coated back surface includes microcapsules containing an initially colorless chemically reactive color-forming dye precursor as the fill material. The front surface of the next sheet, which is adjacent to the back surface of the top sheet, is coated with a material containing a component, such as phenolic resin or reactive clay, that is capable of reacting with the colorless dye precursor contained in the microcapsules to produce a color. Thus, an external pressure on the front surface of the top sheet will rupture the microcapsules on the back surface and release the colorless dye precursor which then chemically reacts with the reactive component of the coated front of the adjacent sheet to produce a colored image corresponding to the area of pressure. Similarly, colored images are produced on each successive sheet of the manifold by the external pressure rupturing the microcapsules carried on the bottom surface of each sheet.

The sheets of the carbonless copying system manifold are designated in the art by the terms CB for "coated back", CFB for "coated front and back", and CF for "coated front". The CB or transfer sheet is usually the top sheet of the manifold and the sheet to which the external pressure is applied. The CFB sheets are the intermediate sheets of the manifold, each of which is able to have an image formed on its front surface by a pressure, and each of which also transmits the contents of ruptured microcapsules from its back surface to the front surface of the next sheet. The CF or recording sheet is the bottom sheet and is coated only on its front surface so that an image can be formed on it.

While it is customary to have the coating containing the microcapsules on the back surface of the sheets and to have the coating containing the reactive component for the capsules on the front surface of each of the sheets, the reverse arrangement is also possible. In addition, one of the reactive ingredients may be carried in the sheets themselves, rather than applied as surface coatings. Furthermore, the component that reacts with the colorless dye precursor may also be microencapsulated.

The microcapsules used in carbonless copying systems generally comprise a core of fill material surrounded by a wall or shell of polymeric material. The wall surrounding the fill material acts to isolate the fill material from the external environment. To release the fill material, e.g., the dye precursor, the capsule wall may be ruptured by an external pressure such as mechanical pressure, thereby introducing the fill material into its surroundings. Generally, the microcapsules comprise separate and discrete capsules having non-interconnecting hollow spaces. The fill material is thus enveloped within the generally continuous polymeric walls of the microcapsules, which may range from about 0.1 to about 500 microns in diameter.

Carbonless copying systems of the type described above have achieved widespread use in the business world. The advent of large scale use of computers and automated handling of information have led to an increased use of mechanized optical reading of documents. Optical character recognition (OCR) devices have been developed which are capable of reading pages of text printed or typed in a format that the OCR device is programmed to read. Typically, such devices read images at or near the near-infrared range of the color spectrum. Although original print, type and carbon copies have light absorptions in the near-infrared range which can be OCR detected, historically this was not true of copies produced by carbonless copying systems using pressure-sensitive record materials. Standard chromogenic materials used in carbonless copying systems do not have light absorptions in the near-infrared range of the color spectrum and thus images produced using such standard chromogenic dye materials have not been readable by OCR devices.

Since conventional carbonless copying system dye precursors thus are not OCR scannable, it has been necessary for many applications to use carbon paper to produce copies that are OCR readable. One of these applications is credit card sales slips. It has been necessary to utilize carbon paper in credit card sales slips since certain areas of the sales slips, such as the card account number area, must be capable of being OCR scanned. As a result, current credit card sales slips suffer from the disadvantage that carbon from the carbon paper often becomes deposited on the user's hands.

Chromogenic dye precursor materials that are usable in carbonless copying systems and which form images having absorption bands in the near-infrared range of the color spectrum have been developed and are disclosed, for example, by U.S. Pat. Nos. 4,020,056, 4,022,771, 4,026,883, 4,107,428 and 4,119,776 and United Kingdom Patents Nos. 124,377, 1,492,913 and 1,496,296. However, these dye precursor materials suffer from the disadvantage that their commercial price is in the range of approximately $90–100 per pound which results in a capsule cost that is more than three times the capsule cost of currently available black microencapsulated dye precursors.

It is therefore an object of the present invention to provide a carbonless copy system that produces copies having images that are detectable by optical character recognition devices.

It is another object of the present invention to provide an economical method for producing copies having images detectable by optical character recognition devices.

It is a further object of the invention to provide a carbonless copying system suitable for use in credit card sales slip sets.

SUMMARY OF THE INVENTION

To achieve the foregoing objects, and in accordance with the purpose of the invention as embodied and broadly described herein, the present invention provides, in one embodiment, a carbonless copying system comprising a recording substrate, a first image-forming component, and a plurality of complementary image-forming components, each encapsulated in microcapsules and capable of reacting with the first image-forming component to produce colored reaction products, at least one of the colored reaction products being detectable by an optical character recognition device. The first image-forming component and the plurality of complementary image-forming components are arranged in juxtaposed contact with one another whereby the application of pressure in selected areas upon the carbonless system causes a colored image to form on corresponding areas of the recording substrate.

Another embodiment of the invention, as embodied and broadly described herein, provides a carbonless copying system comprising a recording substrate, a transfer substrate, a first image-forming component carried by the recording substrate, a first complementary image-forming component encapsulated in microcapsules carried by the transfer substrate and capable of reacting with the first image-forming component to produce a colored reaction product, and a second complementary image-forming component encapsulated in microcapsules carried by selected portions of the transfer substrate, and capable of reacting with the first image-forming component to produce a colored reaction product detectable by an optical character recognition device. The first image-forming component is arranged in juxtaposed contact with the first and second complementary image-forming components whereby the application of pressure in selected areas upon the carbonless system causes colored images to form on corresponding areas of the recording substrate.

In accordance with the invention as embodied and broadly described herein, the present invention further provides a method of producing copy images capable of detection by an optical character recognition device comprising applying to a recording substrate a first image-forming component, applying to a transfer substrate a microencapsulated first complementary image-forming component capable of forming a colored reaction product when reacted with the first image-forming component, applying to selected portions of the transfer substrate a microencapsulated second complementary image-forming component capable of forming a colored reaction product that is detectable by an optical character recognition device, positioning the recording substrate and the transfer substrate whereby the first image-forming component is arranged in juxtaposed contact with the first and second complementary image-forming components, and applying pressure to selected locations of the transfer substrate to rupture the microcapsules of at least one of the first and second complementary image-forming components whereby that component comes into contact with the first image-forming component on the recording substrate to form a colored reaction product on the corresponding location of the recording substrate.

The accompanying drawings, which are incorporated in and constitute a part of this specification, illustrate preferred embodiments of the invention and, together with the description, serve to explain the principles of the invention.

DETAILED DESCRIPTION OF THE PREFERRED EMBODIMENTS

Reference will now be made in detail to the presently preferred embodiments of the invention, examples of which are illustrated in the accompanying drawings.

Figure 1:
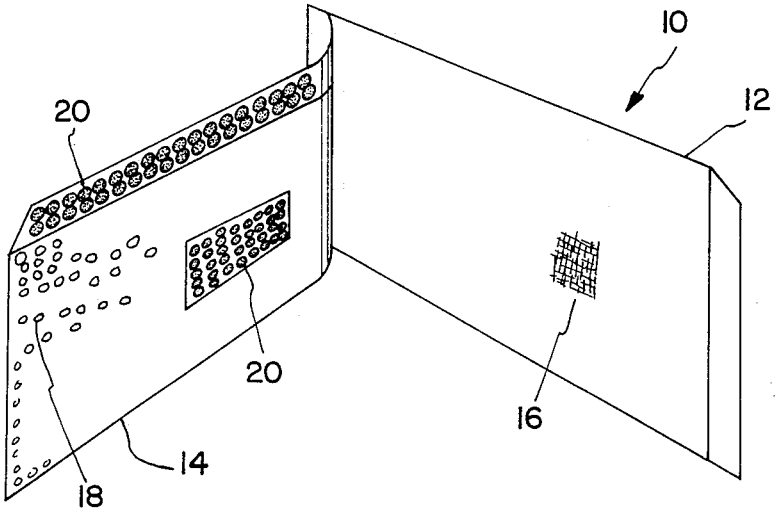
FIG. 1 is a diagram of one embodiment of the carbonless copying system in accordance with the present invention.

In accordance with the present invention as shown in FIG. 1, there is provided a carbonless copy system 10 having a recording substrate 12, a transfer substrate 14, a first image-forming component 16, a first complementary image-forming component 18 and a second complementary image-forming component 20. First image-forming component 16 preferably takes the form of a coating applied to the front or CF portion of recording substrate 12. Representative materials which may be used as the first image-forming component 16 in accordance with the invention include, for example, clays, treated clays (U.S. Pat. Nos. 3,622,364 and 3,753,761), aromatic carboxylic acids such as salicylic acid, derivatives of aromatic carboxylic acids and metal salts thereof (U.S. Pat. No. 4,022,936), phenolic developers (U.S. Pat. No. 3,244,550), acidic polymeric material such as phenol-formaldehyde polymers, etc. (U.S. Pat. Nos. 3,455,721 and 3,672,935), and metal-modified phenolic resins (U.S. Pat. Nos. 3,732,120 and 3,737,410). Preferably, first image-forming component 16 comprises an acidic clay or a phenolic resin. Within the scope of the invention, first image-forming component 16 can also be encapsulated in microcapsules.

In accordance with the invention, first image-forming component 16 can be applied to recording substrate 12 by, for example, utilizing a binder such as starch/latex to adhere the phenolic resin or acidic clay thereto.

In accordance with the invention, first complementary image-forming component 18 takes the form of a colorless dye precursor encapsulated in microcapsules. Representative colorless dye precursors that can be utilized as first complementary image-forming component 18 include, for example, crystal violet lactone, benzoyl leucomethylene blue, rhodamine lactam, the p-toluene sulfinate of Michler's hydrol, and any of the various chromogenic compounds that are capable of changing from a colorless to a colored form on contact with an acidic substance, such as a phenolic resin or a reactive clay.

In accordance with the invention, second complementary image-forming component 20 is also a colorless dye precursor encapsulated in microcapsules and is carried by selected portions of transfer substrate 14. Second complementary image-forming component 20 is selected from those dye precursors that are capable of reacting with first image-forming component 16 to produce a colored reaction product that is detectable by an optical character recognition (OCR) device. Dye precursors capable of forming OCR detectable images are those compounds having near-infrared absorption and include, for example, the compounds disclosed by U.S. Pat. Nos. 4,020,056, 4,022,771, 4,026,883, 4,107,428 and 4,119,776, the fluorene-spiro-lactone compounds disclosed by United Kingdom Patent No. 124,377 and the vinyl-containing compounds disclosed by United Kingdom Patents Nos. 1,492,913 and 1,496,296.

In accordance with the invention, the microcapsules utilized for enveloping the dye precursor material may comprise a shell or wall of polymeric material, may have generally continuous walls and may range from about 0.1 to about 500 microns in diameter. First and second complementary image-forming components 18 and 20 can be adhered to transfer substrate 14 by utilizing a known binder, such as a polyvinyl alcohol.

In accordance with one embodiment of the present invention, as illustrated in FIG. 1, second complementary image-forming component 20 is carried by selected portions of transfer substrate 14 by "strip-coating" thereto and first complementary image-forming component 18 is carried by those portions of transfer substrate 14 that do not carry second complementary image-forming component 20.

Figure 2:
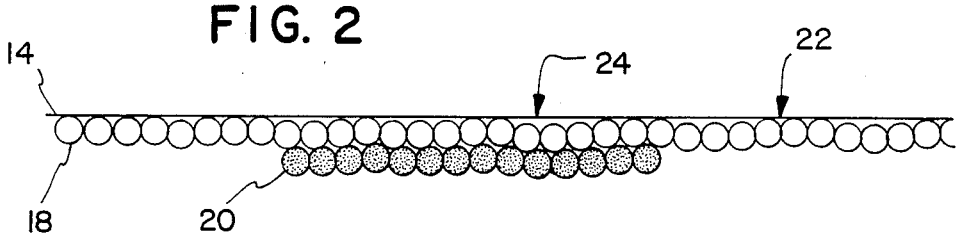
FIG. 2 is a cross sectional diagram of the transfer substrate of the carbonless copying system in accordance with a second embodiment of the invention.

In accordance with a second embodiment of the present invention, as illustrated in FIG. 2, first complementary image-forming component 18 is carried by the entire surface of transfer substrate 14 and second complementary image-forming component 20 is carried by selected portions of transfer substrate 14 by affixing or "strip-coating" the microcapsules containing second complementary image-forming component 20 to selected portions of the layer of microcapsules containing first complementary image-forming component 18 on transfer substrate 14. Microcapsules containing second complementary image-forming component 20 can be adhered to a selected portion of the microcapsules containing first complementary image-forming component 18 by utilizing any binder material known in the art for preparing microcapsular coatings, such as a polyvinyl alcohol binder.

The walls of the microcapsules of the present invention can be ruptured by the application of pressure, such as that caused by a pen or other writing implement, or a printing device such as a typewriter. Upon rupture of the microcapsules, the dye precursor material is introduced into its surroundings. First and second complementary image-forming components 18 and 20, which take the form of dye precursors, are capable of reacting with first image-forming component 16, i.e., the phenolic resin or reactive clay, to produce colored reaction products. The colored reaction products formed by first and second complementary image-forming components 18 and 20 may be identical or different colors.

In accordance with the invention, recording substrate 12 and transfer substrate 14 are arranged adjacent to one another so that first image-forming component 16 and first and second complementary image-forming components 18 and 20 are in juxtaposed, i.e., pressure-sensitive, contact with respect to one another.

In accordance with the embodiment of the invention illustrated by FIG. 1, when pressure is applied to transfer substrate 14 at locations corresponding to areas containing first complementary image-forming component 18, microcapsules of first complementary image-forming component 18 are ruptured and the contained dye precursor is released to contact and react with first image-forming component 16 on recording substrate 12 to form a standard colored image thereon. When pressure is applied to transfer substrate 14 corresponding to those locations containing second complementary image-forming component 20, microcapsules of second complementary image-forming component 20 are ruptured and the contained dye precursor is released to contact and react with first image-forming component 16 on recording substrate 12 to form a colored image thereon that is capable of being detected by an OCR device.

In accordance with the embodiment of the invention illustrated by FIG. 2, when pressure is applied to transfer substrate 14 at location 22, microcapsules of first complementary image-forming component 18 are ruptured and the contained dye precursor is released to contact and react with a first image-forming component on a recording substrate (not shown) to form a standard colored image thereon. When pressure is applied to position 24 on transfer substrate 14, both microcapsules of first and second complementary image-forming components 18 and 20 are ruptured and the contained dye precursors are released to contact with a first image-forming component on a recording substrate to form a colored image thereon that is capable of being detected by an OCR device. If first and second complementary image-forming components 18 and 20 are dye precursors that form different colored images, then the images formed by application of pressure at position 24 on transfer substrate 14 will be that color that is a combination of the individual colors formed by first and second complementary image-forming components 18 and 20.

By strip-coating microencapsulated dye precursors that are capable of OCR detection only in those areas of the carbonless copying system to be scanned or "read" by OCR devices and applying conventional microencapsulated dye precursor materials elsewhere, the quantity of expensive near-infrared dye precursor material that is required is minimized. Therefore, a carbonless copying system capable of producing copy images that are OCR detectable is produced that is not cost prohibitive and thus is economically feasible.

In accordance with another embodiment of the invention, there is provided a carbonless copying system 10 having only a recording substrate 12, i.e., without a transfer substrate 14 (not shown). In this embodiment, recording substrate 12 would contain first image-forming component 16 and at least first and second complementary image-forming components 18 and 20. The external pressure would be applied to recording substrate 12 causing the microcapsules containing first and second complementary image-forming components 18 and 20 to rupture, thus releasing first and second complementary image-forming components 18 and 20 which then contact and react with first image-forming component 16 to form a colored reaction product detectable by an optical character recognition device.

In accordance with the invention, carbonless copying system 10 may also contain a plurality of intermediate substrates, or CFB (coated front and back) sheets (not shown), located between transfer substrate 14 and recording substrate 12. These intermediate substrate sheets are coated on the front side with an image-forming component corresponding to first image-forming component 16 on recording substrate 12, and are also coated on the back side with complementary image-forming components corresponding to first and second complementary image-forming components 18 and 20 on transfer substrate 14. Thus, the intermediate sheets are capable of functioning as both recording and transfer sheets by forming the colored reaction products on their front side like recording substrate 12, and they also enable the transfer of the first and second complementary image-forming components 18 and 20 to successive sheets, like transfer substrate 14. This enables the formation of multiple copies of sheets, each sheet containing the standard colored images and also the colored images that are capable of being detected by OCR devices.

In accordance with the invention, carbonless copying system 10 may also contain more than two complementary image-forming components, i.e., more than two image-forming components containing dye precursors. Transfer substrate 14 may contain a plurality of complementary image-forming components containing dye precursors and recording substrate 12 may also contain a plurality of complementary image-forming components containing dye precursors. All of the image-forming components can be applied to selected portions of the substrates to enable the formation of a plurality of desired colored images on selected portions of the recording substrate, with at least one of the colored images being detectable by an optical character recognition device.

The carbonless copying system of the present invention is particularly suitable for use as a credit card sales slip system. Currently, credit card sales slip systems utilize carbon paper which produces copying images that are OCR scannable, however these systems are inconvenient in that the user may be forced to handle the carbon paper to remove the cardowner copy which may result in a deposit of carbon material on the user's hands. In addition, many users feel compelled to destroy the carbon paper to prevent its possible misuse and thus additional carbon material is deposited on the user's hands. The carbonless copying system of the present invention eliminates the need for messy carbon paper and provides a carbonless credit card sales slip that is capable of producing images that are OCR scannable in selected areas, such as the area containing the card account number.

Although the present invention has been described in connection with preferred embodiments, it is understood that modifications and variations may be resorted to without departing from the spirit and scope of the invention. Such modifications are considered to be within the purview and scope of the invention and the appended claims.

What is claimed is:

1. A carbonless copying system comprising:

a recording substrate;

a first image-forming component; and a plurality of complementary image-forming components, each encapsulated in microcapsules and capable of chemically reacting with said first image-forming component to produce colored chemical reaction products, at least one of said colored chemical reaction products being detectable by an optical character recognition device;

said first image-forming component and said plurality of complementary image-forming components being arranged in juxtaposed contact with one another whereby the application of pressure in selected areas upon the carbonless system causes a colored image to form on corresponding areas of said recording substrate.

2. The carbonless copying system of claim 1, wherein said first image-forming component is an acidic clay or phenolic resin and is carried by said recording substrate.

3. The carbonless copying system of claim 2, wherein said complementary image-forming components are colorless dye precursors.

4. The carbonless copying system of claim 3, wherein at least one of said complementary image-forming components is a dye precursor capable of forming a colored image having near-infrared light absorption.

5. A carbonless copying system comprising:

a recording substrate;

a transfer substrate;

a first image-forming component carried by said recording substrate;

a first complementary image-forming component encapsulated in microcapsules carried by said transfer substrate and capable of chemically reacting with said first image-forming component to produce a colored chemical reaction product; and a second complementary image-forming component encapsulated in microcapsules carried by selected portions of said transfer substrate and capable of chemically reacting with said first image-forming component to produce a colored chemical reaction product detectable by an optical character recognition device;

said first image-forming component being arranged in juxtaposed contact with said first and second complementary image-forming components whereby the application of pressure in selected areas upon the carbonless system causes colored images to form on corresponding areas of said recording substrate.

6. The carbonless copying system of claim 5, wherein said first complementary image-forming component is carried by portions of said transfer substrate not carrying said second complementary image-forming component.

7. The carbonless copying system of claim 5, wherein said first complementary image-forming component is carried by the entire surface of said transfer substrate and said second complementary image-forming component is affixed to selected portions of said first complementary image-forming component.

8. The carbonless copying system of claim 5, wherein said first image-forming component is an acidic clay or phenolic resin.

9. The carbonless copying system of claim 8, wherein said first and second complementary image-forming components are colorless dye precursors.

10. The carbonless copying system of claim 9, wherein said second complementary image-forming component is a dye precursor capable of forming a colored image having near-infrared light absorption.

11. The carbonless copying system of claim 10, wherein said dye precursor capable of forming a colored image having near-infrared absorption is selected from fluorene-spiro-lactone compounds and vinyl phthalides.

12. A method of producing copying images capable of detection by an optical character recognition device comprising:

applying to a recording substrate a first image-forming component;

applying to a transfer substrate a microencapsulated first complementary image-forming component capable of forming a colored chemical reaction product with said first image-forming component;

applying to selected portions of said transfer substrate a microencapsulated second complementary image-forming component capable of forming a colored chemical reaction product detectable by an optical character recognition device;

positioning said recording substrate and said transfer substrate whereby said first image-forming component is in juxtaposed contact with said first and second complementary image-forming components; and applying pressure to selected locations of said transfer substrate to rupture the microcapsules of at least one of said first and second complementary image-forming components whereby said component comes into contact with said first image-forming component on said recording substrate to form a colored chemical reaction product thereon.

13. The method of claim 12, wherein said first complementary image-forming component is applied to those portions of said transfer substrate not containing said second complementary image-forming component.

14. The method of claim 12, wherein said first complementary image-forming component is applied to the entire surface of said transfer substrate and said second complementary image-forming component is applied to selected portions of said transfer substrate on said first complementary image-forming component.

15. The method of claim 12, wherein said first image-forming component is an acidic clay or phenolic resin.

16. The method of claim 15, wherein said first and second complementary image-forming components are colorless dye precursors.

17. The method of claim 16, wherein said second complementary image-forming component is a dye precursor capable of forming a colored image having near-infrared light absorption.

18. The method of claim 17, wherein said dye precursor capable of forming a colored image having near-infrared absorption is selected from fluorene-spiro-lactone compounds and vinyl phthalides.

* * * * *